United States Patent [19]

Nishikawa

[11] 4,371,257

[45] Feb. 1, 1983

[54] AUTOMATIC CONTROLLER OF ELECTRIFICATION OF MAGNETIC TONER

[75] Inventor: Masaji Nishikawa, Hachioji, Japan

[73] Assignee: Olympus Optical Company Limited, Tokyo, Japan

[21] Appl. No.: 281,392

[22] Filed: Jul. 8, 1981

[30] Foreign Application Priority Data

Jul. 14, 1980 [JP] Japan ..... 55-95855

[51] Int. Cl.[3] ..... G03G 15/00

[52] U.S. Cl. ..... 355/14 D; 118/657; 355/3 DD

[58] Field of Search ..... 355/14 D, 3 DD; 118/624, 644, 647, 656–658

[56] References Cited

U.S. PATENT DOCUMENTS 3,879,737 4/1975 Lunde ..... 118/647 X
3,909,258 9/1975 Kotz .
4,194,830 3/1980 Ohnuma et al. ..... 355/3 DD
4,286,543 9/1981 Ohnuma et al. ..... 118/658 X

*Primary Examiner*—R. L. Moses
*Attorney, Agent, or Firm*—Fleit & Jacobson

[57] ABSTRACT

In an electrophotographic developing unit including a magnet roll to apply developer consisting of electrically-insulated magnetic toner particles to a latent image to be developed and an electrifying device to electrify the magnetic toner particles in one polarity, the disclosed automatic controller has a detecting electrode disposed where the magnet roll forms ear-ups of the developer, the detecting electrode receiving a bias voltage of the opposite polarity to that of the electric charge on the magnetic toner particles, a photocell cooperating with a light source in detecting the amount of toner particles attracted by the detecting electrode so as to produce a signal representing the thus detected amount, and a control circuit to control the electrifying device in response to the signal from the photocell.

10 Claims, 9 Drawing Figures

AUTOMATIC CONTROLLER OF ELECTRIFICATION OF MAGNETIC TONER

BACKGROUND OF THE INVENTION

1. Field of the Invention

This invention relates to an automatic controller of electrification of magnetic toner, and more particularly to an automatic controller which maintains a predetermined level of electrification for developer containing magnetic toner particles which electrification renders developing capacity to the developer. The automatic controller of the invention is for a developing unit having a magnet roll means to magnetically hold and carry developer containing electrically-insulated magnetic toner particles toward a latent image to be developed and a means to electrify the magnetic toner particles being carried by the magnet roll means.

2. Description of the Prior Art

The art of using a magnet roll means for applying magnetic toner containing enclosed magnetic particles to a surface to be developed has been known, for instance by the disclosure in U.S. Pat. No. 3,909,258. It is also known that there are two developing methods using magnetic toner; namely, (1) a method in which electrically-conductive magnetic toner particles are provided with electric charge of the opposite polarity to that of the electrostatic latent image by using the conductivity thereof, i.e., through a charging circuit formed from the magnetic toner particle, whereby developing capacity is rendered to the magnetic toner; and (2) a method in which magnetic toner particles having a high electric insulation are provided with electric charge of the opposite polarity to that of the electrostatic latent image by various means, whereby developing capacity is rendered to the magnetic toner.

The latter method of using the magnetic toner particles with a high electric insulation has an advantage of stably holding the electric charge because of the insulation of the toner particles, so that this method is particularly suitable to those electrophotographic devices which produce a final picture by transferring a toner image developed on a photosensitive member to an image-receiving paper.

Various improvements have been proposed in the electrifying process of the magnetic toner particles, which process is applicable to developer containing magnetic toner particles with a high electric insulation and to developing units of electrophotographic devices using the transfer of toner images. For instance, (1) in the case of developer exclusively consisting of highly insulating magnetic toner particles of homogeneous inner construction, electric charge is applied to the magnetic toner particles either (i) by triboelectricity between such toner particles and the sleeve of a magnet roll means, which sleeve is insulated or coated with certain substance selected on the basis of its position on the triboelectric series, or (ii) by means of a corona electrifier on an electrode for injecting electric charge; (2) in the case of magnetic toner made of inner magnetic material and outer insulating material, electric charge is applied to the particles by triboelectric effect due to contact of adjacent toner particles; and (3) in the case of magnetic toner particles to be electrified by triboelectricity, the magnetic toner particles are mixed with magnetic or non-magnetic particles made of a certain substance whose position on the triboelectric series is different from that of the magnetic toner particles, so that the magnetic toner particles are electrified by the triboelectricity between the two kinds of particles.

The aforesaid process for electrification of the magnetic toner particles of the prior art has a particular shortcoming in that it is difficult to keep the amount of electric charge on the magnetic toner particles at a constant level, so that it has been difficult to uniformly hold the developing capacity and the transferring efficiency of the toner image.

SUMMARY OF THE INVENTION

Therefore, an object of the present invention is to obviate the aforesaid shortcoming of the prior art by providing an improved automatic controller of electrification of magnetic toner to be used in a developing unit. The automatic controller of the invention is featured in four points: i.e., firstly, the developing capacity of the magnetic toner is always kept constant; secondly, the electric charge on the magnetic toner particles is maintained at a constant level; thirdly, the transferring efficiency of the toner image is prevented from fluctuating; and fourthly, a predetermined amount of electric charge is applied to the magnetic toner particles.

Generally speaking, developer containing magnetic toner particles is carried by a magnet roll means based on the magnetic properties of the toner particles. The developing capacity of such developer depends on the difference between magnetic force to attract the toner and the Coulomb force of the electrostatic latent image to attract the toner. Accordingly, all or a part of the toner can be formed of magnetic toner particles, and fluctuation of the ratio at which the magnetic toner particles are added in the toner does not cause any change in the developing capacity. To maintain a constant developing capacity, it is very important to keep the electric charge on the magnetic toner particles at a constant level.

To fulfill the aforesaid objects, the inventors noted the abovementioned importance of the constant electric charge on the magnetic toner particles. Thus, the automatic controller for the electrification of magnetic toner according to the present invention is characterized by detecting the amount of electric charge on the magnetic toner particles and controlling the electrification of the magnetic toner particles based on the result of the detection. More particularly, the present invention provides an automatic controller of electrification of magnetic toner to be used in a developing unit having a magnet roll means adapted to magnetically hold and carry developer containing electrically-insulated magnetic toner particles to a surface to be developed, and an electrifying means for electrifying the magnetic toner particles being carried by the magnet roll means. The automatic controller includes a detecting electrode disposed adjacent to a position where ear-ups of the developer are formed by the magnet roll means. A bias voltage means applies a bias voltage to the detecting electrode, the polarity of the bias voltage being opposite to that of electric charge on the magnetic toner particles. A light source is disposed by the detecting electrode and optically coupled with a photocell so as to detect the amount of magnetic toner particles deposited on the detecting electrode. The photocell produces a detection signal representing the amount of magnetic toner particles thus detected, and a control circuit is adapted to control operation of the electrifying means on the basis of the detection signal from the photocell.

Although a preferred embodiment of the invention uses a photocell to detect the amount of toner particles attracted by a given potential difference, such photocell can be replaced with any other suitable photosensitive element capable of detecting brightness, such as cadmium sulfide (CdS), a photoconductive cell, a photo diode, or a photo transistor.

BRIEF DESCRIPTION OF THE DRAWINGS

For a better understanding of the invention, reference is made to the accompanying drawings, in which.

DETAILED DESCRIPTION OF THE PREFERRED EMBODIMENTS

Throughout different views of the drawings, 1 is magnetic toner, 2 is a toner hopper, 3 is a non-magnetic sleeve, 4 is a magnet, 5 is a magnet roll means, 6 is an electrifying electrode, 7 is a gap, 8 is an electrifying power source, 9 is a sensor, 10*a* and 10*b* are developing bias voltage sources, 11 is a charge holder, 20 is an ear-up, 21 is a light-transmitting plate, 22 is a transparent electrode, 23 is a lamp, 24 is a photocell, 25 is a sensor housing, 26 is an end of lead wire, 27 is a lead wire, 30 is an operational amplifier, 31 is a holder, 31*a* is a hold-instruction circuit, 31*b* is a holding circuit, 32 is an outside signal circuit, 33 is an amplification control circuit, 40 is a motor control circuit, 41 is an outside signal input terminal, 42 is a hold signal input terminal, 43 is a motor-driving power source, 44 is a motor for rotating the non-magnetic sleeve, 50 is a transparent electrode plate, 51 is a conductive layer of the transparent substrate, 52 is a lamp, 53 is a photocell, 60 and 64 are shafts, 61 and 61' are flange portions, 62 and 62' are bearings, 63 and 65 are motors, 70 is a friction plate, 71 is a support pin, 72 is a spring, 73 is a solenoid, 73*a* is a plunger, and 74 is a sensor.

Figure 1:
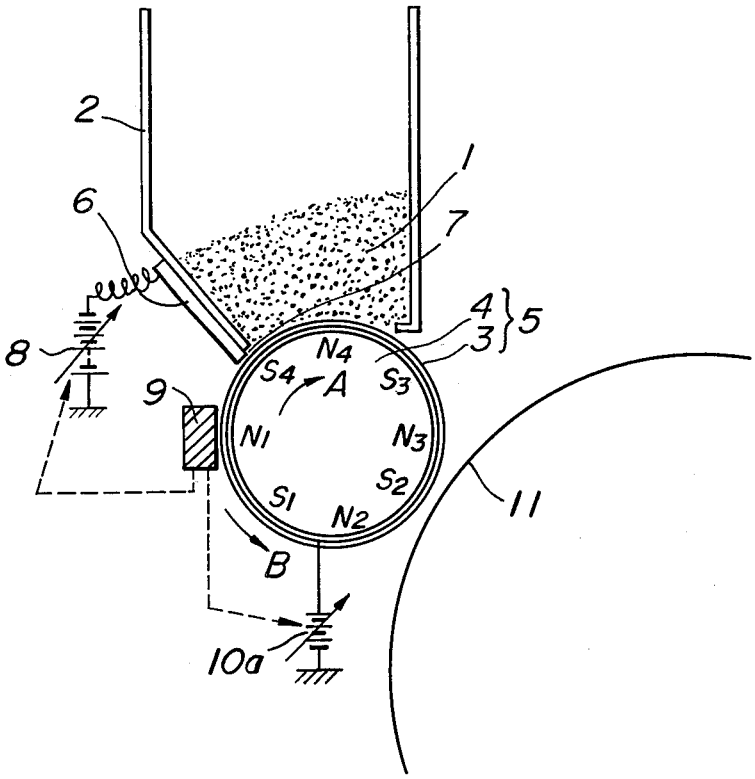
FIG. 1 is a schematic sectional view of an embodiment of the automatic controller of electrification of magnetic toner according to the present invention.
Figure 2A:
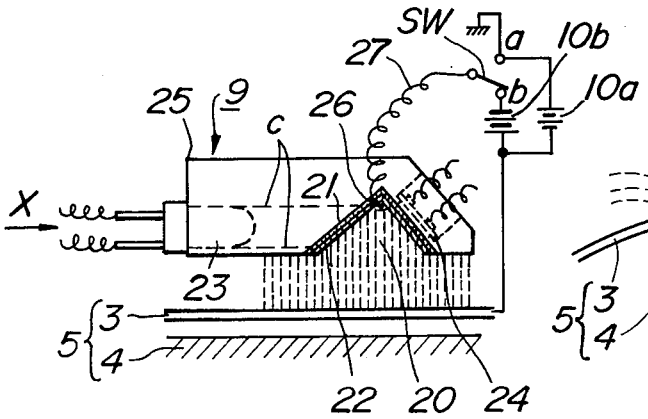
FIGS. 2A and 2B are an elevation and a side view of a sensor used in the automatic controller of FIG. 1, which elevation and side view are taken from two mutually orthogonal directions so as to illustrate the construction and the disposition of the sensor.
Figure 2B:
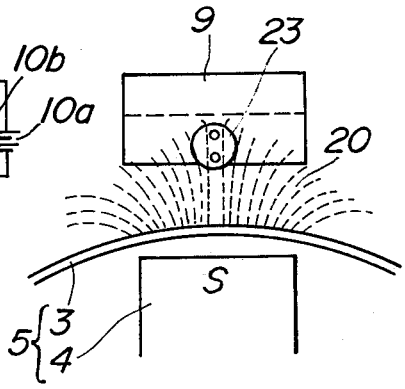

Referring first to FIG. 1 showing an embodiment of the automatic controller of electrification of magnetic toner according to the present invention, developer solely consisting of electrically-insulated magnetic toners 1 is kept in a toner hopper 2. A non-magnetic sleeve 3 and a magnet 4 are coaxially assembled so as to form a magnet roll means 5. When the non-magnetic sleeve 3 is turned in the direction of the arrow B or when the magnet 4 is turned in the direction of the arrow A, the magnetic toner 1 moves on the surface of the non-magnetic sleeve 3 in the direction of the arrow B. The magnetic toner 1 is eared up at a magnetic pole of the magnet 4 as shown in FIGS. 2A and 2B. As the magnetic toner 1 is magnetically held and carried on the surface of the non-magnetic sleeve 3, a layer of the magnetic toner 1 is formed thereon whose thickness is controlled by a gap 7 between the non-magnetic sleeve 3 and a charge injecting or electrifying electrode 6. An electrifying power source 8 is connected to the electrifying electrode 6 so as to inject electric charge onto the magnetic toner 1 thus controlled at the gap 7. A sensor 9 is disposed in the proximity of the non-magnetic sleeve 3 at such a position that the sensor 9 contacts the ear-ups of the magnetic toner 1. The sensor 9 is adapted to detect the amount of magnetic toner 1 deposited thereon and to generate a detection signal which is fed back to the circuit of the electrifying power source 8, and the output voltage of the electrifying power source 8 is controllable in response to the detection signal. If necessary, a developing bias voltage source 10*a* is connected across the non-magnetic sleeve 3 of the magnet roll means 5 and ground potential, so as to apply a developing bias voltage to the non-magnetic sleeve 3. A charge holder 11 faces the non-magnetic sleeve 3.

FIGS. 2A and 2B illustrate, on a scale larger than that of FIG. 1, the construction and disposition of the sensor 9 of FIG. 1. In FIG. 2A, the sensor 9 is shown as seen from the electrifying electrode 6 of FIG. 1, while FIG. 2B is taken from the direction of the arrow X, namely from the left-hand side of FIG. 2A.

The magnetic toner 1 forms a developer layer on the surface of the non-magnetic sleeve 3 disposed in the close proximity of the magnet 4, and one magnetic pole of the magnet 4, e.g., S pole in FIG. 2B, acts to form ear-ups 20 of the magnetic toner 1. The sensor 9 has a light-transmitting plate 21 disposed at a position adjacent to the ear-ups 20 of the magnetic toner 1, a transparent electrode 22 formed by coating a transparent electrically-conductive layer on one surface of the light-transmitting plate 21, and a combination of a lamp 23 at one side of the transparent electrode 22 and a photocell 24 at its opposite side. An optical path C is formed from the lamp 23 to the photocell 24 through the transparent electrode 22 as shown by the dotted lines of FIG. 2A. A sensor housing 25 holds the aforesaid components of the sensor 9, i.e., the light-transmitting plate 21, the transparent electrode 22, the lamp 23 and the photocell 24.

One end 26 of a lead wire 27 is connected to the transparent electrode 22. Another developing bias voltage source 10*b* can be connected to the opposite end of the lead wire 27 through a switch SW, so that a bias voltage whose polarity is opposite to that of the electric charge on the magnetic toner 1 is applied to the transparent electrode 22 relative to the non-magnetic sleeve 3. To improve the measuring accuracy of the developing capacity of the magnetic toner 1 and to increase amplitude of the detected signal, the switch SW at one end of the lead wire 27 and the developing bias voltage sources 10*a* and 10*b* are connected in such a manner that two bias voltages whose polarities are the same as and opposite to that of the electric charge on the magnetic toner 1 are selectively applied to the transparent electrode 22. When the bias voltage of the same polarity as that of the electric charge on the magnetic toner 1 is applied to the transparent electrode 22, the magnetic toner 1 is expelled from the transparent electrode 22, whereas when the bias voltage of the opposite polarity to that of the electric charge on the magnetic toner 1 is applied to the transparent electrode 22, the magnetic toner 1 is accumulated on the transparent electrode 22. Thus, the alternate application of the bias voltages of the opposing polarities causes the detection signal, i.e., the output signal, from the sensor, to increase and decrease alternately, or if necessary periodically. On the other hand, it is also possible to detect variation of the developing capacity based on changes in the electric charge of the magnetic toner 1, by applying only such bias voltage which has the opposite polarity to that of the electric charge on the magnetic toner 1. However, as compared with the alternate application of bias voltages of both polarities, the application of only that bias voltage whose polarity is opposite to that of the electric charge on the magnetic toner 1 results in an increased amount of the magnetic toner 1 accumulated on the transparent electrode 22 and the magnitude of the detection signal from the photocell 24 of the sensor 9 tends to become small. Accordingly, extensive amplification of the detected signal becomes necessary in order to provide signals having sufficient amplitude for controlling the amount of electric charge on the magnetic toner 1. Besides, relative variations of the detected signal for a given change in the amount of the electric charge on the magnetic toner 1 becomes small, and the sensitivity of the detection by the sensor 9 tends to become lower.

Figure 3:
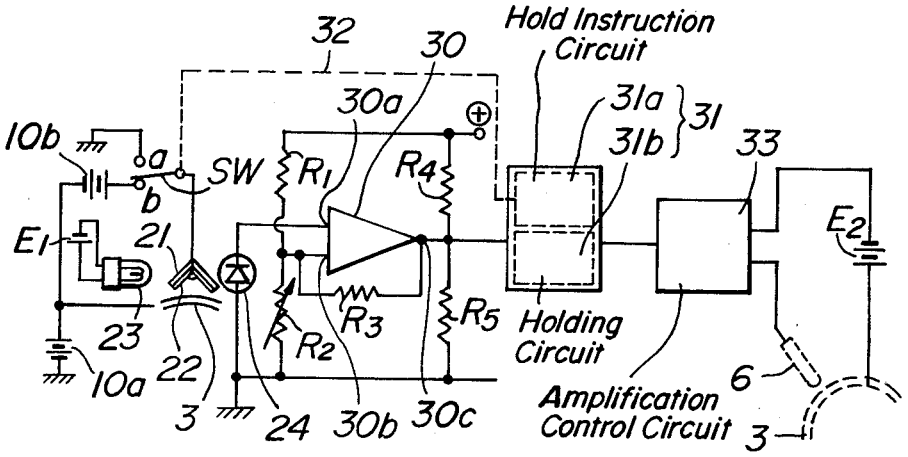
FIG. 3 is a schematic diagram showing the formation and operation of a control circuit for controlling electrification of magnetic toner in response to signals from the aforesaid sensor.

FIG. 3 is a schematic diagram which shows the formation and operation of a control circuit for controlling the electric charge on the magnetic toner 1 in accordance with the signal from the aforesaid sensor 9. In the ensuing description, the symbols of FIGS. 1, 2A and 2B are used to designate like parts as far as applicable.

Referring to FIG. 3, the lamp 23 connected to a power source $E_1$ is disposed at one side of the transparent electrode 22, while the photocell 24 is disposed at the opposite side of the transparent electrode 22. Although the illustrated photocell 24 is assumed to be photovoltage type, the photocell 24 can be of any other type which responds to the light from the lamp 23 siuch as a cadmium sulfide (CdS) photoconductive cell, a photo diode, a photo transistor, or a photoelectric tube. FIG. 3 also shows the developing bias voltage source 10*a* connected to the non-magnetic sleeve 3, which is electrically conductive, so as to apply a developing bias voltage thereto. The transparent electrode 22 is selectively connectible to ground potential and the other developing bias voltage source 10*b* through the terminals a and b of a periodically operable switch SW, so that a voltage of the same polarity as that of the electric charge on the magnetic toner 1 and a voltage of the opposite polarity to that of the electric charge on the magnetic toner 1 are alternately applied to the transparent electrode 22 relative to the potential of the non-magnetic sleeve 3.

A photovoltage induced at the photocell 24 is applied to one input terminal 30*a* of an operational amplifier 30. A reference voltage produced by dividing a power source voltage through resistors $R_1$ and $R_2$ is applied to a reference voltage terminal 30*b* of the operational amplifier 30, so that the operational amplifier 30 operates based on the voltages at the terminals 30*a* and 30*b*. The level of the output at the output terminal 30*c* of the operational amplifier 30 depends on the resistors $R_4$ and $R_5$, and such output level is fed back to the reference voltage input terminal 30*b* through a feedback resistor $R_3$. Thus, the operational amplifier 30 operates as a proportional amplifying circuit to produce an output signal at the output terminal 30*c* which output signal is proportional to a differential voltage $\Delta V$ between the input terminals 30*a* and 30*b*. The output signal from the operational amplifier 30 has a saw-toothed waveform because the voltage applied to the transparent electrode 22 is periodically switched as described above. It is preferable to hold the minimum value of the output signal, or the instantaneous value thereof at a predetermined timing, for a duration which is substantially the same as the period of said periodic switching of the voltage at the transparent electrode 22.

The output signal from the output terminal 30*c* of the operational amplifier 30 is applied to a holder 31. The holder 31 has a hold-instruction circuit 31*a* which instructs hold and reset operations, and a holding circuit 31*b* which carries out the hold in response to instruction from the hold-instruction circuit 31*a*. If the hold operation is to be effected at the peak value of the output signal from the operational amplifier 30, the hold-instruction circuit 31*a* detects a timing at which the signal from the operational amplifier 30 is reversed at the peak value thereof and controls the holding circuit 31*b* based on such detection. To carry out the hold operation at a predetermined timing of the aforesaid periodic switching, for instance, the voltage of the transparent electrode 22 is applied to the hold-instruction circuit 31*a* through a signal line 32 so that the hold-instruction circuit 31*a* is actuated on the basis of the voltage thus applied thereto. An amplification control circuit 33 converts the signal from the holding circuit 31*b* into an electric signal which is suitable for controlling the electrification of the magnetic toner 1. In the embodiment of FIG. 3, the amount of the electric charge to be applied to the magnetic toner 1 is controlled by regulating the DC voltage being applied across the non-magnetic sleeve 3 and the electrifying electrode 6, so that the amplification control circuit 33 controls the voltage from a DC power source $E_2$ based on the output signal from the holding circuit 31*b*. Thus, when the amount of electric charge on the magnetic toner 1 is small, a high DC voltage is applied across the electrifying electrode 6 and the non-magnetic sleeve 3. As the amount of electric charge on the magnetic toner 1 increases, the quantity of the magnetic toner 1 deposited on the transparent electrode 22 decreases, so that the voltage applied across the electrifying electrode 6 and the non-magnetic sleeve 3 is reduced. In this way electrification is controlled in such a manner that electric charge on the magnetic toner 1 is kept constant in a desired manner. Should the amount of electric charge on the magnetic toner 1 be increased successively with rotation of the non-magnetic sleeve 3 or the magnet 4, the electrifying electrode 6 may be used for preventing the electric charge on the magnetic toner 1 from increasing excessively, by applying, to the electrifying electrode 6, voltage of the opposite polarity to that of the electric charge on the magnetic toner 1. In this case, when the quantity of toner deposited on the transparent electrode 22 is large, the voltage is applied to the electrifying electrode 6.

In the case of using a developer whose magnetic toner 1 is electrified by triboelectrically as mentioned above, another example of the control of electrification is contemplated in which the rotation of the non-magnetic sleeve 3 or the magnet 4 causing the triboelectric electrification is regulated.

Figure 4:
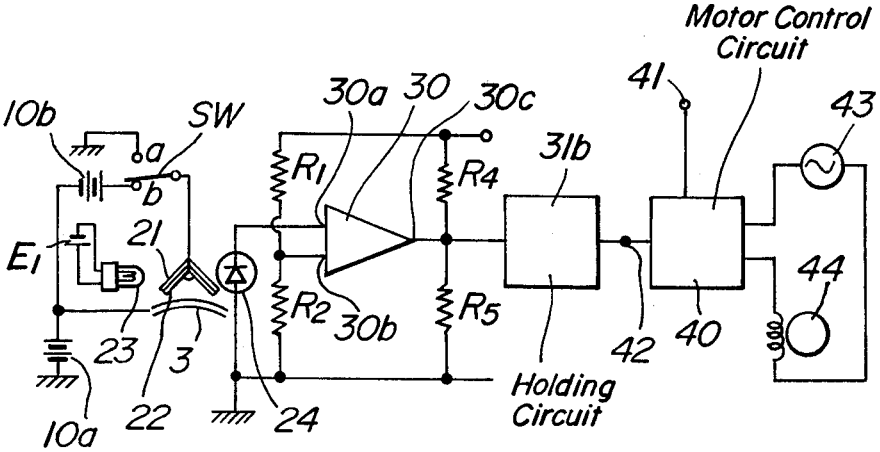
FIG. 4 is a schematic diagram showing formation of a control circuit that controls rotation of a non-magnetic sleeve in response to detected amount of electric charge on the magnetic toner particles.

FIG. 4 is a schematic diagram showing another embodiment of the automatic controller of electrification of magnetic toner 1 according to the present invention, wherein a non-magnetic sleeve 3 of the automatic controller can be rotated not only during the developing process but also during an additional period, and the additional period of rotating the non-magnetic sleeve 3 is controlled on the basis of the detected amount of electric charge on the magnetic toner 1.

The embodiment of FIG. 4 is different from that of FIG. 3 in that no feedback resistor for the operational amplifier 30 is provided, so that the output signal from the output terminal 30*c* is of the on-off type, which output signal is held for a predetermined time by the holding circuit 31*b*. A motor control circuit 40 carries out a so-called on-off control of a motor or a clutch for controlling the rotation of the non-magnetic sleeve 3. The motor control circuit 40 has an external signal input terminal 41 to receive a signal for controlling the duration of the motor rotation based on the operating sequence of an electrophotographic device and another input terminal 42 to receive a signal from the holding circuit 31*b* in response to the detection of the fact that the amount of electric charge on the magnetic toner 1 is small.

Under the control of the input through the external signal input terminal 41, the non-magnetic sleeve 3 can be rotated for a minimum period of time for a developing process, while the non-magnetic sleeve 3 can be rotated for an additional period of time based on the signal from the circuit which detects the amount of electric charge on the magnetic toner 1. The motor control circuit 40 is connected to a motor-driving power source 43 and a motor 44 for driving the non-magnetic sleeve 3.

The formation of the detector to detect the amount of electric charge on the magnetic toner 1 should be properly selected by considering the grain size of the developer, the concentration of the magnetic material in the developer, and the intensity of magnetization of the magnet 4 of the magnet roll means 5. For instance, when the magnetic properties of the developer are weak or when the intensity of magnetization of the magnet 4 is weak, the height of the ear-ups 20 is low and the ear-ups 20 of the developer hardly reach the transparent electrode 22 of FIG. 2. If the ear-ups 20 of the developer are low, it is preferable to use a movable toner-collector electrode which comes in contact with tip portions of the ear-ups 20. The movable toner-collector electrode is adapted to move to a detector portion where the amount of the deposited toner, such as the toner deposited on the aforesaid transparent electrode 22, is photoelectrically detected, which detector portion is located away from the position of the ear-ups of the developer, as shown in FIG. 5.

Figure 5:
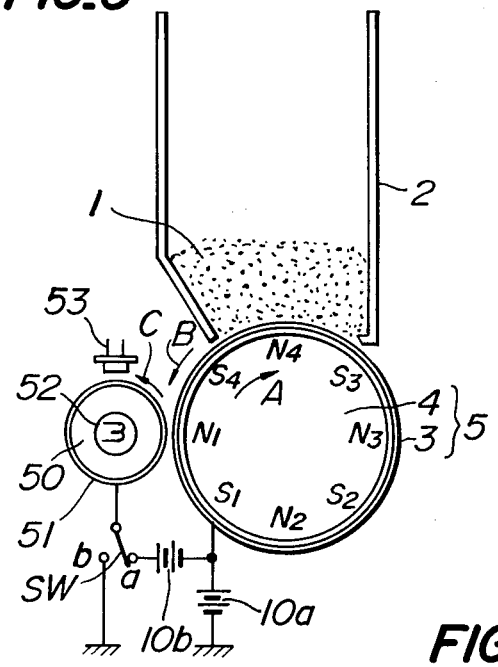
FIG. 5 is a schematic sectional view of another embodiment of the automatic controller of electrification of magnetic toner according to the present invention.

FIG. 5 is a schematic sectional view of another embodiment of the automatic controller of electrification of magnetic toner of the invention.

In this embodiment, a transparent substrate 50 is formed in cylindrical shape and an electrically-conductive transparent layer 51 is applied on the outer surface thereof. The cylindrical transparent substrate 50 is supported by a flange which is not shown, and a bias voltage is applied to the flange through a slip ring and bearing means (not shown). The transparent conductive layer 51 is electrically connected to the aforesaid flange for instance by a suitable conductive adhesive. The cylindrical transparent substrate 50 is supported in such a manner that it is rotatable in the direction of the arrow C of FIG. 5, and a lamp 52 is fixedly arranged inside the cylindrical transparent substrate 50. A photocell 53 is disposed so as to face the transparent conductive layer 51 formed on the outer surface of the transparent substrate 50, whereby the amount of the magnetic toner 1 deposited on the cylindrical electrode plate 50 is photoelectrically detected by the photocell 53.

The application of the bias voltage to the transparent conductive layer 51 and the treatment of the detected signals can be carried out in a manner similar to that of the preceding embodiment as described hereinbefore by referring to FIGS. 2 through 4. In the embodiment of FIG. 5, the cylindrical transparent substrate 50 rotates while attracting the magnetic toner 1 as the development proceeds, so as to come to the detector portion. The amount of the deposited magnetic toner 1 being detected by the photocell 53 is somewhat reduced during the travel up to the photocell 53, and there is a time lag from the application of the bias voltage to the detection of the deposited magnetic toner 1. Accordingly, the detection signal in the embodiment of FIG. 5 is different from that of the sensor 9 of FIG. 2, but it is easy for those skilled in the art to deal with such differences of the detection signal by properly modifying the control circuit so as to compensate for the differences.

Figure 6:
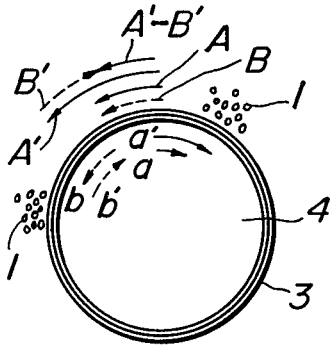
FIG. 6 is an explanatory diagram which illustrates principles concerning relative movements among a non-magnetic sleeve, a magnet, and developer in the automatic controller of electrification of magnetic toner according to the present invention.

FIG. 6 is a diagram showing the principles of relative movements among the non-magnetic sleeve 3, the magnet 4, and the magnetic toner (developer) 1 in the automatic controller of electrification of magnetic toner according to the present invention.

In the example of FIG. 6 to convey the magnetic toner (developer) 1, the non-magnetic sleeve 3 and the magnet 4 are controlled in such a manner that either one or both of them can rotate at a time. Further, depending on the amount of electric charge on the magnetic toner 1, the rotation of the sleeve 3 may be switched over to the rotation of the magnet 4 and vice versa, and, when one of the sleeve 3 and the magnet 4 is rotated, the remaining one of them can be additionally actuated to switch into simultaneous rotations of both of the non-magnetic sleeve 3 and the magnet 4.

Before explaining the principles of FIG. 6, the following observations will be pointed out: namely, when the magnetic toner (developer) 1 is carried at a constant speed to a surface to be developed, (1) if the magnet 4 is held at rest while only the non-magnetic sleeve 3 is rotated, the relative displacement between the magnetic toner (developer) 1 and the non-magnetic sleeve 3 is about one tenth (1/10) of the rotation speed of the non-magnetic sleeve 3, and (2) if the non-magnetic sleeve 3 is held at rest while only the magnet 4 is rotated, the relative speed between the non-magnetic sleeve 3 and the magnetic toner (developer) 1 is substantially the same as the travelling speed of the magnetic toner (developer) 1.

Referring to FIG. 6, when the magnet 4 is rotated at a constant speed in the direction of the arrow a, the magnetic toner (developer) 1 moves on the non-magnetic sleeve 3 over a distance of the arrow A per unit time, and the magnetic toner 1 travels relative to the non-magnetic sleeve 3 by a distance which is substantially the same as said arrow A. On the other hand, when the magnet 4 is held at rest and the non-magnetic sleeve 3 is rotated in the direction of the arrow b at a speed of about one tenth (1/10) of the rotation in the direction of the arrow a, the magnetic toner (developer) 1 moves per unit time over a distance of the arrow B which distance is nearly the same as that of the arrow A. However, the relative displacement between the non-magnetic sleeve 3 and the magnetic toner (developer) 1 is about one tenth (1/10) of that of the arrow B. Accordingly, when the amount of electric charge on the magnetic toner 1 is small, the magnetic toner (developer) 1 can be carried by rotating only the magnet 4 while the non-magnetic sleeve 3 is held at rest. On the other hand, when the amount of electric charge on the magnetic toner 1 is large, the magnet 4 may be held at rest while the non-magnetic sleeve 3 may be rotated.

Although the details of the modification of the relative speed between the non-magnetic sleeve 3 and the magnetic toner (developer) 1 will be described hereinafter by referring to FIG. 7, it is noted here that the modification can be achieved by controlling the combination of rotations of the non-magnetic sleeve 3 and the magnet 4. To begin with, when the magnet 4 is rotated at a constant speed in the direction of the arrow a the magnetic toner (developer) 1 moves on the non-magnetic sleeve 3 in the direction of the arrow A by a distance equivalent to the length of the arrow A per unit time. When the revolving speed of the magnet 4 is doubled as shown by the arrow a', the magnetic toner (developer) 1 moves on the non-magnetic sleeve 3 by twice the length of the arrow A per unit time as shown by the arrow A'. If the non-magnetic sleeve 3 is rotated simultaneously in the direction of the arrow b' at a rate of displacement equivalent to the length of the arrow A per unit time, the magnetic toner (developer) 1 is forced backward in the direction of the arrow B' at a rate of displacement equivalent to the length of the arrow A per unit time. Consequently, the magnetic toner (developer) 1 moves as shown by the arrow A'-B', which arrow A'-B' represents the movement of the same direction and the same displacement per unit time as those in the case of the rotation of the magnet 4 alone in the direction of the arrow a, so that substantially the same effects can be achieved on the surface being developed. However, in this case of simultaneous rotations of the non-magnetic sleeve 3 and the magnet 4, the relative speed between the non-magnetic sleeve 3 and the magnetic toner (developer) 1 per unit time is as shown by the arrow A' which is about twice as fast as that in the case of rotating the magnet 4 alone.

As can be seen from the foregoing explanation, the moving speed of the magnetic toner (developer) 1 toward the surface being developed and the relative speed between the non-magnetic sleeve 3 and the magnetic toner (developer) 1 can be selected at will within certain ranges, by rotating both of the magnet 4 and the non-magnetic sleeve 3 while suitably setting the revolving directions and speeds thereof. Accordingly, it becomes possible to quickly move the magnetic toner (developer) 1 relative to the non-magnetic sleeve 3 when the amount of electric charge on the magnetic toner (developer) 1 is small, and to reduce the speed of the magnetic toner (developer) 1 relative to the non-magnetic sleeve 3 as the amount of electric charge on the magnetic toner (developer) 1 increases, so as to prevent excessive increase of the electric charge on the magnetic toner 1. A preferable method of development is to effect the developing process while preventing the excessive increase of the amount of electric charge on the magnetic toner, which preferable method is carried out by rotating the non-magnetic sleeve 3 alone, and such preferable method can be advantageously combined with the aforesaid method of simultaneously rotating both of the non-magnetic sleeve 3 and the magnet 4.

Figure 7:
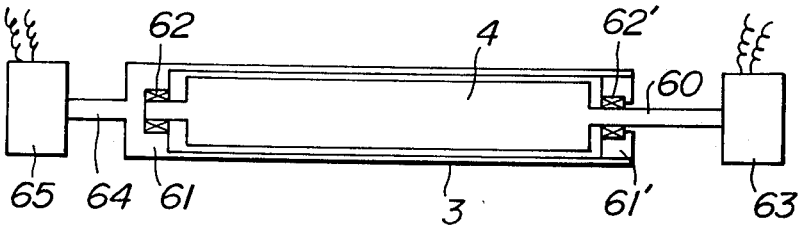
FIG. 7 is an explanatory diagram of relationship between a magnet roll means and motors for independently rotating a non-magnetic sleeve and a magnet.

FIG. 7 is an explanatory diagram of an arrangement of motors for independently rotating the non-magnetic sleeve 3 and the magnet 4. A shaft 60 of the magnet 4 is journaled by bearings 62, 62' embedded in flange portions 61, 61' of the non-magnetic sleeve 3, so that the magnet 4 is rotatable relative to the non-magnetic sleeve 3. One end of the shaft 60 extends out of the flange portion 61' of the non-magnetic sleeve 3 and is connected to a motor 63 so as to be driven thereby. The non-magnetic sleeve 3 is rotatably held at the flange portions 61, 61', and one flange portion 61 has a shaft 64 extending therefrom, and another motor 65 is connected to the shaft 64 so as to drive the non-magnetic sleeve 3. Accordingly, the non-magnetic sleeve 3 and the magnet 4 can be independently rotated by selectively supplying electric power to the motor 63 connected to the shaft 60 of the magnet 4 and to the motor 65 connected to the shaft 64 of the non-magnetic sleeve 3, so that the relative speed between the magnetic toner (developer) 1 and the non-magnetic sleeve 3 can be modified. The control of the power supply to the motors 63 and 65 depends on the amount of electric charge on the magnetic toner 1 as detected at the transparent electrode 22 (FIG. 2A) or 50 (FIG. 5).

Figure 8:
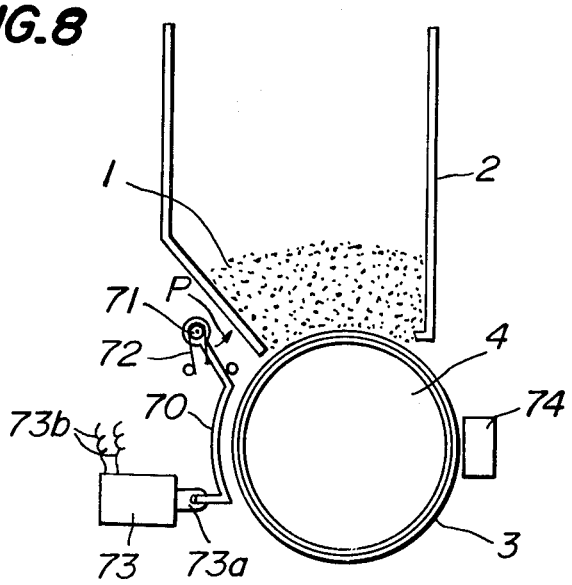
FIG. 8 is a schematic sectional view of a further different embodiment of the automatic controller of electrification of magnetic toner according to the present invention.

FIG. 8 is a schematic sectional view of an essential portion of another embodiment of the automatic controller of electrification of magnetic toner according to the present invention.

The embodiment of FIG. 8 has a friction plate 70 to electrify the magnetic toner 1 by triboelectricity. One end of the friction plate 70 is pivotally supported by a support pin 71 and normally urged by a spring 72 in the direction of the arrow P. The opposite end of the friction plate 70 is connected to a plunger **73*a* of a solenoid 73, and the solenoid 73 is energized by an electric current applied thereto through lead wires 73*b* depending on a detection signal from a sensor 74. At least the surface of the friction plate 70 must be made of a material whose position on the triboelectric series is apart from that of the magnetic toner 1. The preferable material for the surface of the friction plate 70 to electrify the magnetic toner 1 with positive electric charge is polytetrafluoroethylene, polyvinyl chloride, or the like, while the preferable material for the surface of the friction plate 70 to electrify the magnetic toner 1 with negative electric charge is glass, mica, polyamide imide, or the like. The position of the friction plate 70 must be such that the tips of the ear-ups 20 of the magnetic toner 1 formed by the magnet 4 come in contact with the friction plate 70, provided that the friction plate 70** is at its operative position.

Although the foregoing detailed description refer to automatic control of the operation of a controller of electrification on the basis of a signal representing the result of detecting the amount of electric charge on magnetic toner, it is also possible to dispense with the mechanism for such automatic control and to manually control the operation of a controller of electrification on the basis of visual judgement of the picture being developed. The amount of electric charge on the magnetic toner may be detected by a means different from the aforesaid sensor, so as to form an automatic controller of electrification wherein the operation of a controller of electrification is controlled on the basis of signals from said means different from the aforesaid sensor. In the embodiments explained above, the detecting electrode is made of transparent material and the photocell detects light transmitted through the electrode. This construction has an advantage that the photocell is shielded from the toner by the electrode. However, as the case may be, the detecting electrode may be made reflective and the photocell may receive light reflected by the electrode.

As described in detail in the foregoing, according to the present invention, a magnetic roll means holds and carries magnetic toner of developer to a surface to be developed, and the magnetic toner being thus carried is attracted by a detecting electrode with a bias voltage applied thereto so as to detect the amount of electric charge on the magnetic toner on the basis of the amount of the toner deposited on the detecting electrode and to produce a detection signal representing the thus detected amount of electric charge on the magnetic toner, and electrification of the magnetic toner is controlled on the basis of the detection signal, whereby the electric charge of the magnetic toner can be always kept constant and the object of the invention to stabilize the developed picture is fulfilled.

Although the invention has been described with a certain degree of particularity, it is understood that the present disclosure has been made only by way of example and than numerous changes in details of construction and the combination and arrangement of parts may be resorted to without departing from the scope of the invention as hereinafter claimed.

What is claimed is:

1. In an automatic controller of electrification of magnetic toner for a developing means having a magnet roll means to magnetically hold and carry developer containing electrically-insulated magnetic toner particles toward a surface to be developed, said magnetic toner particles having magnetic material particles enclosed therein, and an electrifying means related to said magnetic roll means so as to electrify the magnetic toner particles being held by said magnetic roll means, the improvement comprising a detecting electrode disposed adjacent to a position where ear-ups of the developer are formed by said magnet roll means, a bias voltage means applying a bias voltage to said detecting electrode, the polarity of said bias voltage being opposite to that of electric charge on said magnetic toner particles, a light source disposed to project light to the detecting electrode, a photocell disposed to receive the light so as to produce a detection signal representing an amount of the magnetic toner particles deposited on said detecting electrode, and a control circuit adapted to control operation of said electrifying means on the basis of said detection signal from said photocell.

2. An automatic controller of electrification of magnetic toner as set forth in claim 1, wherein said electrifying means has an electric charge injecting means disposed at a position where said magnetic toner particles being carried by said magnet roll means come in contact therewith, and a second bias voltage means applying a bias voltage to said electric charge injecting means relative to said magnet roll means; and wherein said control circuit has a voltage control means adapted to modify at least one of the voltage level and polarity of said bias voltage applied to said electric injecting means in response to said detection signal from said photocell.

3. An automatic controller of electrification of magnetic toner as set forth in claim 2, wherein said electric charge injecting means is an electric charge injecting electrode and said second voltage means is a DC high voltage source.

4. An automatic controller of electrification of magnetic toner as set forth in claim 1, wherein said electrifying means has a triboelectric member made of a substance whose position on the triboelectric series is apart from that of the magnetic toner particles, said triboelectric member being disposed in the proximity of a position where said magnetic toner particles carried by said magnet roll means come in contact therewith, an actuating means being coupled to said triboelectric member so as to selectively cause the triboelectric member to come in contact with the magnetic toner particles, and said control circuit being adapted to selectively energize said actuating means on the basis of said detection signal from said photocell.

5. An automatic controller of electrification of magnetic toner as set forth in claim 4, wherein said actuating means is an electromagnetic solenoid having a plunger connected to said triboelectric member and a coil electrically connected to said control circuit and magnetically coupled to said plunger.

6. An automatic controller of electrification of magnetic toner as set forth in any one of claims 4 and 5, wherein said control circuit has an amplifier means with an input terminal connected to said photocell and an output terminal connected to said actuating means, the magnitude of a signal from said output terminal of the amplifier means to said actuating means being controlled in response to the magnitude of said detection signal from said photocell to said amplifier means.

7. An automatic controller of electrification of magnetic toner as set forth in claim 1, said magnetic roll means has a rotatable magnet and a rotatable non-magnetic sleeve made of a substance whose position on the triboelectric series is apart from that of the magnetic toner particles, said electrifying means is a driving means adapted to independently rotate said rotatable magnet and said non-magnetic sleeve, and said control circuit is adapted to selectively actuate said driving means on the basis of said detection signal from said photocell so as to control relative speed between said rotatable non-magnetic sleeve and said magnetic toner particles.

8. An automatic controller of electrification of magnetic toner as set forth in claim 7, wherein said control circuit has an amplifier means with an input terminal connected to said photocell and an output terminal connected to said driving means, the magnitude of a signal from said output terminal of the amplifier means to said driving means being controlled in response to the magnitude of said detection signal from said photocell to said amplifier means.

9. An automatic controller of electrification of magnetic toner as set forth in claim 7, wherein said control circuit comprises a comparator for comparing the detection signal from the photocell with a reference signal to produce a first signal when the amount of toner deposited on the detecting electrode is smaller than a predetermined amount and a second signal when the amount of toner on the detecting electrode is larger than the predetermined amount, and a circuit for controlling the driving circuit in such a manner that the non-magnetic sleeve is rotated, while the magnet is stopped in response to the first signal and the magnet is rotated while the non-magnetic sleeve is stopped in response to the second signal.

10. An automatic controller of electrification of magnetic toner as set forth in claim 7, wherein said control circuit comprises a comparator for comparing the detection signal from the photocell with a reference signal to produce a first signal when the amount of toner on the detecting electrode is smaller than a predetermined amount and a second signal when the amount of toner on the detecting electrode is larger than the predetermined amount, and a circuit for controlling said driving circuit in such a manner that the non-magnetic sleeve is rotated in one direction, while the magnet is stopped in response to said first signal and the non-magnetic sleeve is rotated in the other direction, while the magnet is rotated in the other direction, in response to said second signal.

* * * * *